US008870178B2

(12) United States Patent
Taoka et al.

(10) Patent No.: US 8,870,178 B2
(45) Date of Patent: Oct. 28, 2014

(54) IMAGE FORMING APPARATUS

(71) Applicant: Canon Kabushiki Kaisha, Tokyo (JP)

(72) Inventors: Keitaro Taoka, Tokyo (JP); Hiromasa Katayama, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/950,413

(22) Filed: Jul. 25, 2013

(65) Prior Publication Data

US 2014/0042687 A1 Feb. 13, 2014

(30) Foreign Application Priority Data

Aug. 13, 2012 (JP) ..... 2012-179525

(51) Int. Cl.

*B65H 3/44* (2006.01)
*B65H 1/26* (2006.01)
*B65H 1/00* (2006.01)

(52) U.S. Cl.

CPC ..... *B65H 1/00* (2013.01); *B65H 2801/06* (2013.01); *B65H 2402/64* (2013.01); *B65H 2405/313* (2013.01); *B65H 1/266* (2013.01); *B65H 2405/12* (2013.01)

USPC ..... 271/9.11; 271/9.13; 271/145

(58) Field of Classification Search

USPC ..... 271/9.11, 9.13, 117, 145; 399/391, 393

See application file for complete search history.

(56) References Cited

U.S. PATENT DOCUMENTS

| | | | | |
|---|---|---|---|---|
| 4,032,137 | A | 6/1977 | Katayama et al. | |
| 4,966,356 | A * | 10/1990 | Ohyabu et al. | 271/9.11 |
| 6,674,983 | B2 * | 1/2004 | Enomoto et al. | 399/124 |
| 8,360,418 | B2 * | 1/2013 | Matsuyama et al. | 271/162 |
| 8,528,902 | B2 | 9/2013 | Katayama | |
| 8,684,348 | B2 * | 4/2014 | Matsuyama et al. | 271/164 |
| 2009/0033023 | A1 * | 2/2009 | Shirasaki | 271/145 |

FOREIGN PATENT DOCUMENTS

JP 10-157225 A 6/1998

* cited by examiner

*Primary Examiner* — Ernesto Suarez

(74) *Attorney, Agent, or Firm* — Fitzpatrick, Cella, Harper & Scinto

(57) ABSTRACT

Provided is an image forming apparatus capable of improving operation performances. Sheet feeding cassettes and having sheet stacking portions SS1 and SS2 and sheet feeding portions, which are engaged and provided on the upstream side of the sheet stacking portions SS1 and SS2 in a pulling-out direction in an engaging and disengaging manner and feed the sheet stored in the sheet stacking portions SS1 and SS2, are vertically disposed at a plurality of positions in an image forming apparatus main body so that the sheet feeding cassette can be pulled out. Moreover, when the sheet feeding operation using the lower sheet feeding cassette is performed, only the sheet stacking portion SS1 of the sheet feeding cassette is pulled out, and when the sheet feeding operation stops, the sheet stacking portion SS1 and the sheet feeding portion of the sheet feeding cassette are integrally pulled out.

7 Claims, 17 Drawing Sheets

FIG. 5

| CONDITION | UPPER STAGE FEEDING DRIVING | LOWER STAGE FEEDING DRIVING | PORTION LEFT IN APPARATUS MAIN BODY | PORTION PULLED OUT FROM APPARATUS MAIN BODY |
|---|---|---|---|---|
| UPPER STAGE SHEET SUPPLY DURING FEEDING OF LOWER STAGE CASSETTE | ON | ON | UPPER STAGE: FEEDING PORTION<br>LOWER STAGE: STACKING PORTION, FEEDING PORTION | UPPER STAGE: FEEDING PORTION |
| LOWER STAGE SHEET SUPPLY DURING FEEDING OF UPPER STAGE CASSETTE | ON | OFF | UPPER STAGE: STACKING PORTION, FEEDING PORTION | LOWER STAGE:<br>STACKING PORTION + FEEDING PORTION |
| JAM RECOVERY OF CERTAIN STAGE | OFF | OFF | | UPPER STAGE:<br>STACKING PORTION + FEEDING PORTION<br>LOWER STAGE:<br>STACKING PORTION + FEEDING PORTION |
| SHEET SUPPLY TO CERTAIN STAGE WHEN IMAGE FORMING APPARATUS STOPS | OFF | OFF | | UPPER STAGE:<br>STACKING PORTION + FEEDING PORTION<br>LOWER STAGE:<br>STACKING PORTION + FEEDING PORTION |
| FEEDING PORTION MAINTENANCE OF CERTAIN STAGE | OFF | OFF | | UPPER STAGE:<br>STACKING PORTION + FEEDING PORTION<br>LOWER STAGE:<br>STACKING PORTION + FEEDING PORTION |

IMAGE FORMING APPARATUS

BACKGROUND OF THE INVENTION

1. Field of the Invention

The present invention relates to an image forming apparatus, particularly, to an apparatus in which a plurality of sheet feeding cassettes having a sheet storing portion and a sheet feeding portion configured to feed a sheet stored in the sheet storing portion is vertically disposed.

2. Description of the Related Art

In image forming apparatuses such as a facsimile apparatus, a copying machine, and a printer, a sheet feeding cassette configured to store sheets to be supplied to an image forming portion is mounted on an image forming apparatus main body in a pullable manner. Moreover, in the image forming apparatus, the sheet feeding cassette is pulled out to supply the sheet, and the sheets stored in the sheet feeding cassette are sequentially conveyed to the image forming portion by a sheet feeding unit to perform the image formation onto the sheet at the time of image formation. Furthermore, recently, there has been an increasing demand for formation of an image on a large quantity and various kinds of sheets, and a plurality of sheet feeding cassettes has been vertically disposed in the image forming apparatus main body according to the demand, which makes it possible to cope with storing of a large quantity of sheets and accommodation of various kinds of sheets.

Herein, in the image forming apparatus that includes the sheet feeding cassette, even when the image forming apparatus main body are installed to make the back surface or side surface thereof close to a wall, it is requested to perform the sheet supply, the removal of jammed sheet, and the maintenance of components in the apparatus only from an operation side (front side) of the apparatus. This is to allow the image forming apparatus to be installed and used even in a place of a narrow space.

Thus, in the image forming apparatus of the related art, an apparatus having sheet feeding cassettes vertically provided at a plurality of positions has been suggested. The sheet feeding cassettes have a sheet feeding portion, a sheet conveying route configured to allow the sheet that is fed by the sheet feeding portion to pass therethrough, and an opening and closing door configured to open the sheet conveying route that are provided on a front side of the apparatus (see Japanese Patent Laid-Open No. 10-157225). Moreover, when the sheet is jammed in the sheet conveying route, by opening the opening and closing door to open the sheet conveying route, the jammed sheet can be removed without damage. With such a configuration, it is possible to perform the sheet supply and the removal of the jammed sheet in the sheet conveying route only from the operation side (front side) of the image forming apparatus.

However, in the image forming apparatus vertically provided with a plurality of sheet feeding cassettes of this configuration, for example, when the sheet is fed from the sheet feeding cassette of a lower stage, it is not possible to perform the supply of the sheet to the sheet feeding cassette of an upper stage. Thus, for example, if the sheet feeding portion is provided on the back side of the image forming apparatus, it is possible to supply the sheet to the sheet feeding cassette that is not used for supply of the sheet during an image forming operation. However, when the sheet feeding portion is provided on the back side of the image forming apparatus, there is a need to perform the removal of the jammed sheet from the back side of the image forming apparatus main body with respect to the sheet feeding portion and the sheet conveying route.

Thus, the invention was made in view of such circumstances, and it is desirable to provide an image forming apparatus capable of improving the supply of a sheet to a sheet feeding cassette and jam recovery performances.

SUMMARY OF THE INVENTION

According to the invention, there is provided an image forming apparatus that includes an image forming apparatus main body; a plurality of sheet feeding cassettes that has a sheet storing portion configured to store the sheet, and which is disposed vertically on the lower side of the image forming apparatus main body so that the sheet feeding cassettes can be pulled out, and which is engaged and disengaged with a sheet feeding portion provided on the back side of the sheet storing portion in a pulling-out direction to feed the sheet stored in the sheet storing portion; an engaging portion that is provided in each of the plurality of sheet feeding cassettes, and engages the sheet storing portion and the sheet feeding portion in an engaging and disengaging manner; and an engaging and disengaging portion that is provided in each of the plurality of sheet feeding cassettes, releases the engagement due to the engaging portion in a case where only the sheet storing portion is pulled out, and maintains the engagement due to the engaging portion in a case where the sheet storing portion and the sheet feeding portion are integrally pulled out when the sheet feeding cassette is pulled out.

According to the invention, only the sheet storing portion is pulled out at the time of sheet feeding operation using the lower sheet feeding cassette, and the sheet storing portion and the sheet feeding portion are pulled out when the sheet feeding operation stops, which makes it possible to improve the supply of the sheet to the sheet feeding cassette and jam recovery characteristics.

Further features of the present invention will become apparent from the following description of exemplary embodiments with reference to the attached drawings.

BRIEF DESCRIPTION OF THE DRAWINGS

FIG. 5 is a diagram illustrating pulling-out states of the sheet feeding cassette according to states of the image forming apparatus when the sheet feeding cassette is pulled out;

DESCRIPTION OF THE EMBODIMENTS

Figure 1:
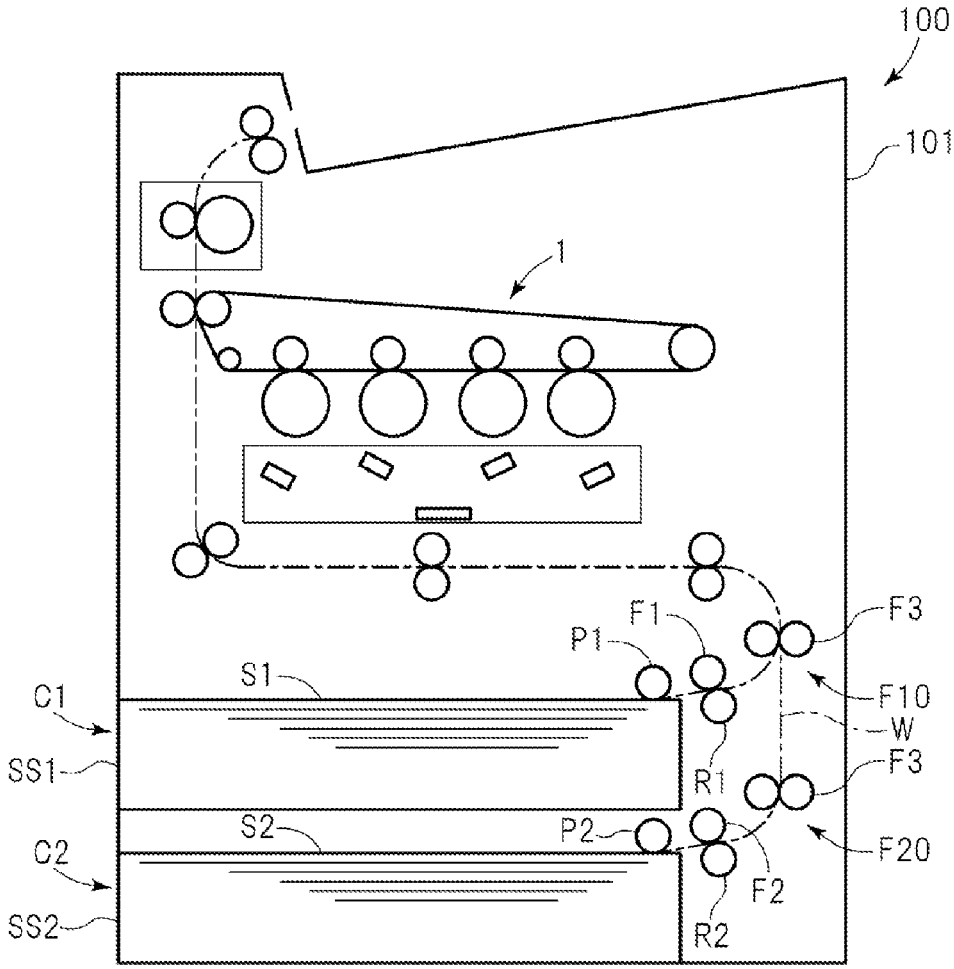
FIG. 1 is a diagram illustrating a schematic configuration of an image forming apparatus according to an embodiment of the invention.

Hereinbelow, embodiments of the invention will be described in detail based on the drawings. FIG. 1 is a diagram illustrating a schematic configuration of an image forming apparatus according to an embodiment of the invention. In FIG. 1, sheet feeding cassettes C1 and C2 are vertically disposed (mounted) at a plurality of positions below an image forming apparatus main body 101 (hereinbelow, referred to as an apparatus main body) of an image forming apparatus 100 provided with an image forming portion 1 and the like. In addition, in the present embodiment, the sheet feeding cassettes are placed at two stages of the upper stage sheet feeding cassette C1 and the lower stage sheet feeding cassette C2.

The sheet feeding cassettes C1 and C2 are a front loading type capable of being pulled out of the front (the left side in FIG. 1, on which the operation of the image forming apparatus, the supply of the sheet, the jam recovery of the sheet and the like are performed) of the apparatus main body 101. Furthermore, the upper stage sheet feeding cassette C1 includes an upper stage sheet stacking portion SS1 serving as a sheet storing portion that stores the sheet, and an upper stage sheet feeding portion F10 that feeds a sheet S1 stored in the upper stage sheet stacking portion SS1 to the image forming portion 1. Furthermore, the lower stage sheet feeding cassette C2 includes a lower stage sheet stacking portion SS2 serving as a sheet storing portion that stores the sheet, and a lower stage sheet feeding portion F20 that feeds a sheet S2 stored in the lower stage sheet stacking portion SS2 to the image forming portion 1. In addition, although the expressions "upper stage" and "lower stage" will not be provided hereinbelow, the expressions "upper stage" and "lower stage" may be added and described as necessary.

The sheet feeding portions F10 and F20 include pickup rollers P1 and P2 that abut against the uppermost surfaces of the sheets S1 and S2 stored in the sheet stacking portions SS1 and SS2 and send out the sheets S1 and S2. Furthermore, the sheet feeding portions F10 and F20 include separation portions that have feed rollers F1 and F2 and retard rollers R1 and R2 for separating the sheets S1 and S2 sent out by the pickup rollers P1 and P2 one by one. Moreover, the sheet feeding portions F10 and F20 include a conveying roller F3 that conveys the sheets S1 and S2 separated by the separation portion to the image forming portion 1, respectively. The sheet feeding portions F10 and F20 provided below the image forming portion 1 are configured so that the pickup rollers P1 and P2, the feed rollers F1 and F2, the retard rollers R1 and R2, the conveying rollers F3 and F3 are each integrally attached to a frame to form a unit.

In the image forming apparatus 100 including the sheet feeding cassettes C1 and C2 of this configuration, when an image is formed on the sheets S1 and S2, first, the sheets S1 and S2 stored in the sheet stacking portions SS1 and SS2 are sent out by the sheet feeding portions F10 and F20. Next, the sent-out sheets S1 and S2 are separated by the separation portion one by one, and then are conveyed to the image forming portion 1 by the conveying roller F3. Next, an image is formed on the sheets S1 and S2 conveyed to the image forming portion 1 using the image forming portion 1, and the sheets S1 and S2 formed with the image are discharged to the upper surface of the apparatus main body 101. In addition, in FIG. 1, a sheet conveying route W is provided on the sheet feeding portion F10 of the upper stage sheet feeding cassette C1 and extends vertically, and a sheet P sent out of the lower stage sheet feeding cassette C2 by the sheet feeding portion F20 is conveyed to the image forming portion 1 through the sheet conveying route W.

Figure 2:
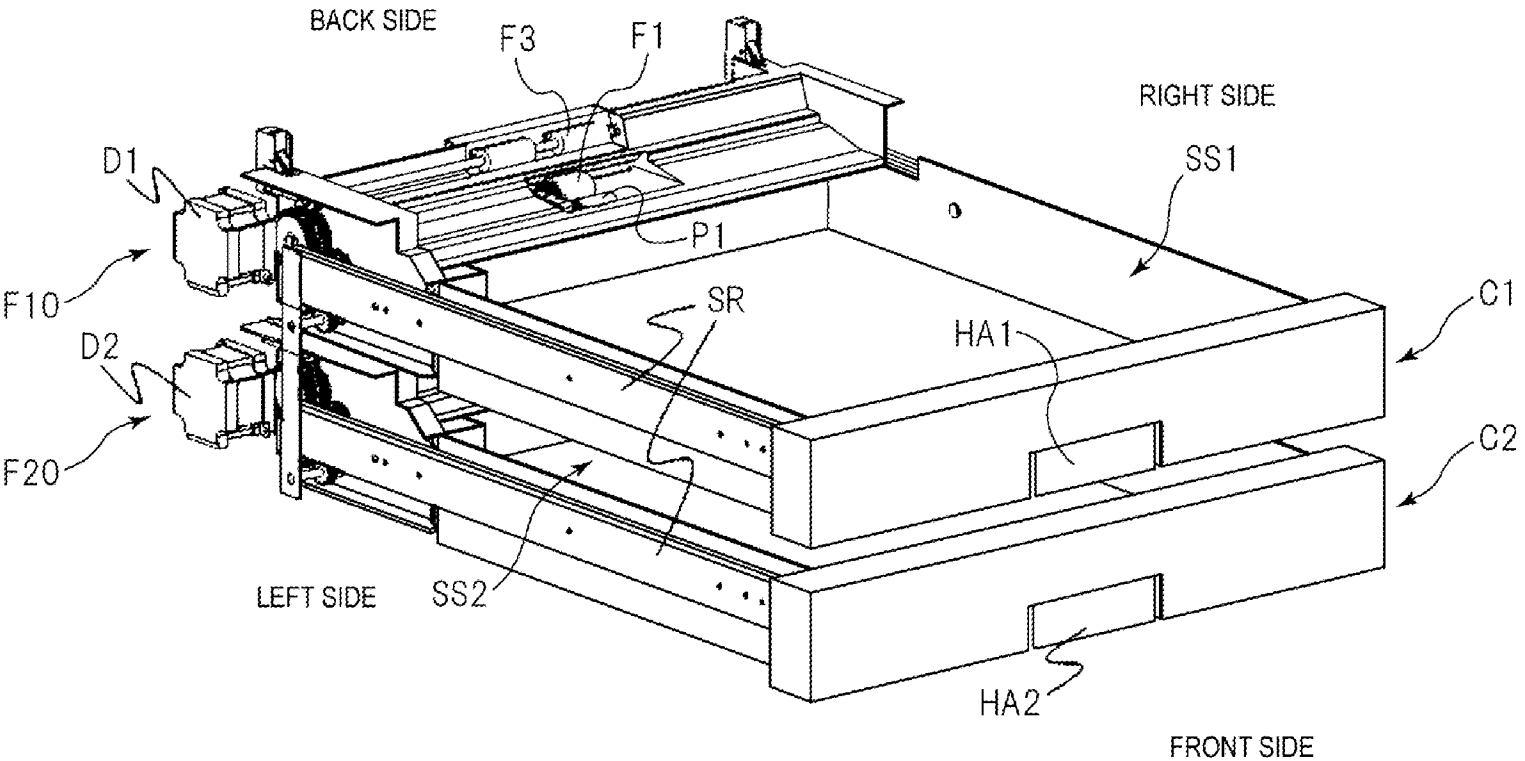
FIG. 2 is a diagram illustrating a state of a sheet feeding cassette stored in an apparatus main body of the image forming apparatus.

FIG. 2 is a diagram illustrating the state of the sheet feeding cassettes C1 and C2 when stored in the apparatus main body 101. In addition, in FIG. 2, a slide rail SR slidably supports the sheet stacking portions SS1 and SS2 with respect to the apparatus main body 101, and handles HA1 and HA2 are provided in front of the sheet stacking portions SS1 and SS2. Furthermore, an upper stage sheet feeding driving portion D1 serves as a driving portion such as a motor that drives the pickup roller P1, the feed roller F1, the retard roller R1, the conveying roller F3 and the like of the upper stage sheet feeding portion F10, respectively. A lower stage sheet feeding driving portion D2 serves as a driving portion such as a motor that drives the pickup roller P2, the feed roller F2, the retard roller R2, the conveying roller F3 and the like of the lower stage sheet feeding portion F20, respectively. In addition, hereinbelow, although "upper stage" and "lower stage" will be omitted, "upper stage" and "lower stage" will be added and described as necessary.

Figure 3A:
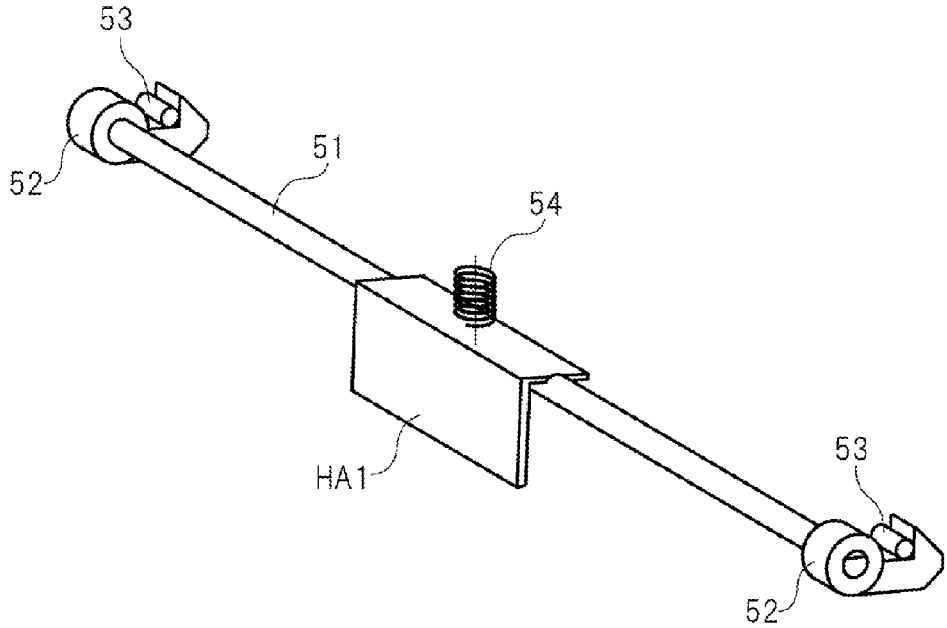
FIGS. 3A to 3C are diagrams illustrating a handle that is provided in the sheet feeding cassette.
Figure 3B:
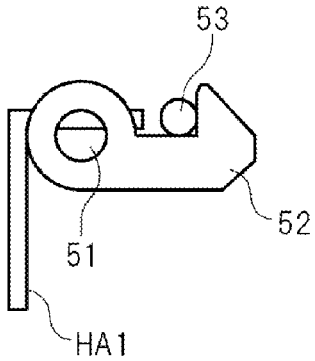
Figure 3C:
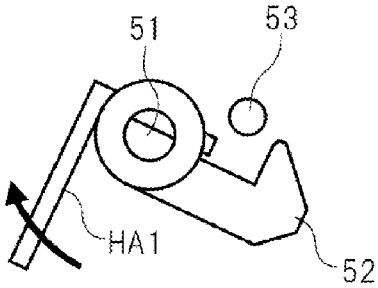

Here, as illustrated in FIG. 3A, a shaft 51 rotatably supported is provided in the handle HA1, and lock members 52 are fixed to both end portions of the shaft 51. Furthermore, an engaging pin 53 is provided in the apparatus main body 101. Force is applied to the lock member 52 in a direction of being engaged with the engaging pin 53 by a spring 54, the lock member 52 is engaged with the engaging pin 53 as illustrated in FIG. 3B, and thus the sheet feeding cassette C1 is fixed to the apparatus main body 101. When the sheet feeding cassette C1 is pulled out of the apparatus main body 101, the handle HA1 is caught and rotated in an arrow direction illustrated in FIG. 3C. Thus, an engaging point between the lock member 52 and the engaging pin 53 rotates downward, the lock member 52 is detached from the engaging pin 53, fixing of the sheet stacking portion SS1 is released, and the sheet feeding cassette C1 can be pulled out.

Figure 4A:
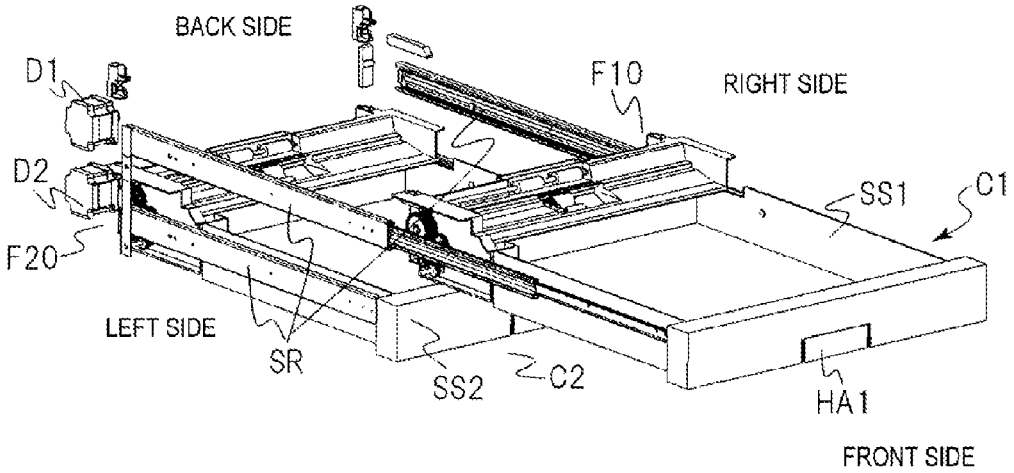
FIGS. 4A and 4B are diagrams illustrating a state when the sheet feeding cassette is pulled out.
Figure 4B:
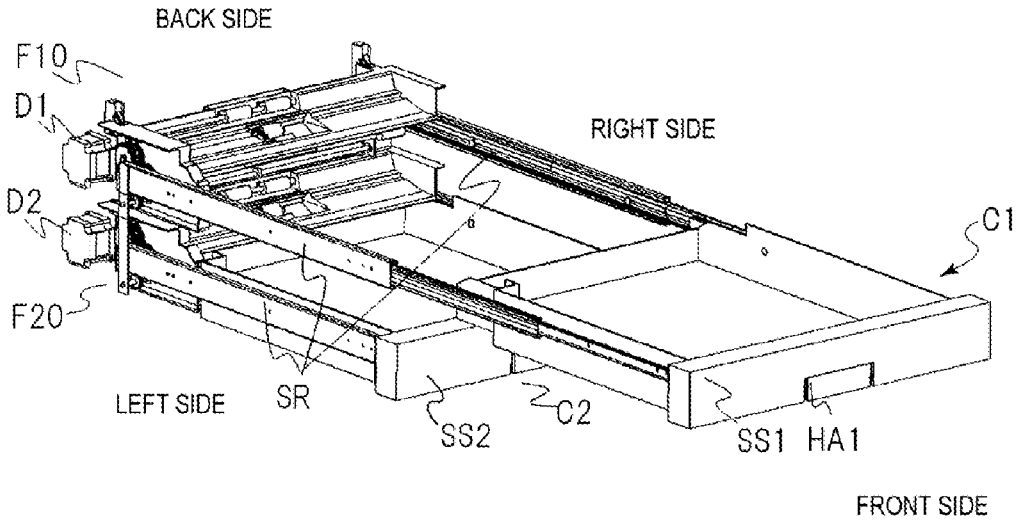

In the present embodiment, the sheet feeding portions F10 and F20 are located on the upstream side of the sheet stacking portions SS1 and SS2 in the pulling-out direction, and are engaged with the sheet stacking portions SS1 and SS2 in a freely engaging and disengaging manner. Moreover, when the sheet feeding cassette C1 is pulled out, as illustrated in FIG. 4A, the sheet feeding cassette C1 can be integrally pulled out in the state where the sheet stacking portion SS1 is engaged with the sheet feeding portion F10. Furthermore, when the engagement between the sheet stacking portion SS1 and the sheet feeding portion F10 is released, as illustrated in FIG. 4B, only the sheet stacking portion SS1 can be pulled out.

The condition as to whether the sheet feeding cassette C1 is integrally pulled out or only the sheet stacking portion SS1 is pulled out will be described. As illustrated in FIG. 5, the conditions include the upper stage sheet supply during lower stage cassette supply, the lower stage sheet supply during upper stage cassette sheet feeding and conveying, the sheet supply to a certain stage at the time of jam recovery of a certain stage and at the time of the image forming apparatus stop, and at the time of maintenance of the sheet feeding portion of a certain stage.

Each of the conditions will be described. While the sheet from the lower stage sheet feeding cassette C2 is fed, in a case where the sheet is supplied to the upper stage sheet feeding cassette C1, when the upper stage sheet feeding cassette C1 is pulled out, only the sheet stacking portion SS1 is drawn. In a case where the sheet is supplied to the lower stage sheet feeding cassette C2 while the sheet is fed from the upper stage sheet feeding cassette C1, when the lower stage sheet feeding cassette C2 is pulled out, the sheet stacking portion SS2 and the sheet feeding portion F20 are integrally pulled out.

Furthermore, in a case where a jam occurs in the sheet feeding portions F10 and F20 and the jammed sheet is processed, when the sheet feeding cassettes C1 and C2 are pulled out, the sheet stacking portions SS1 and SS2 and the sheet feeding portions F10 and F20 are integrally pulled out. A controller C illustrated in FIG. 12 described below detects the jam of the sheet in the sheet feeding portions F10 and F20, based on the detection signal from a jam detecting sensor SEN illustrated in FIG. 12 described below.

At the time of sheet supply when the image forming apparatus 100 stops, when the sheet feeding cassettes C1 and C2 are pulled out, the sheet stacking portions SS1 and SS2 and the sheet feeding portions F10 and F20 are integrally pulled out. Furthermore, at the time of maintenance of the sheet feeding portions F10 and F20, when the sheet feeding cassettes C1 and C2 are pulled out, the sheet stacking portions SS1 and SS2 and the sheet feeding portions F10 and F20 are integrally pulled out.

Next, a configuration in which the sheet stacking portions SS1 and SS2 and the sheet feeding portions F10 and F20 are integrally pulled out or only the sheet stacking portions SS1 and SS2 are pulled out will be described.

Figure 6A:
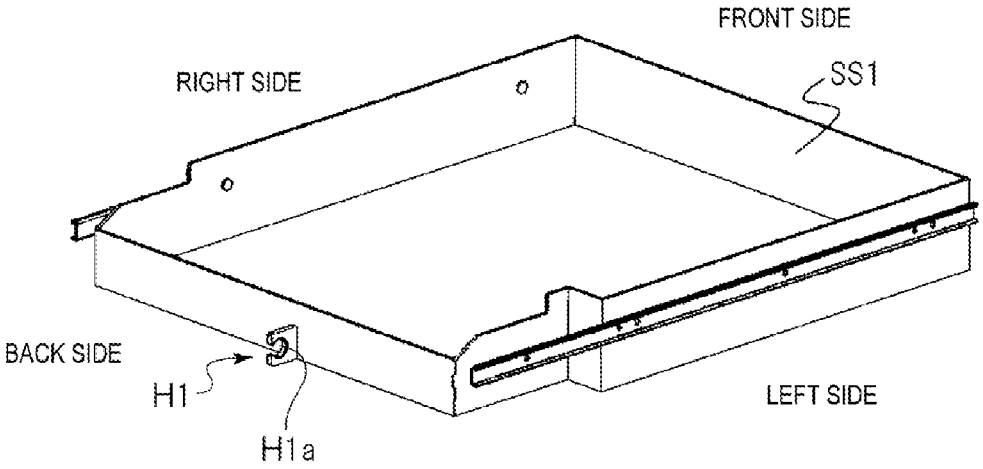
FIGS. 6A and 6B are diagrams illustrating a configuration of a sheet stacking portion that is provided in the sheet feeding cassette.
Figure 6B:
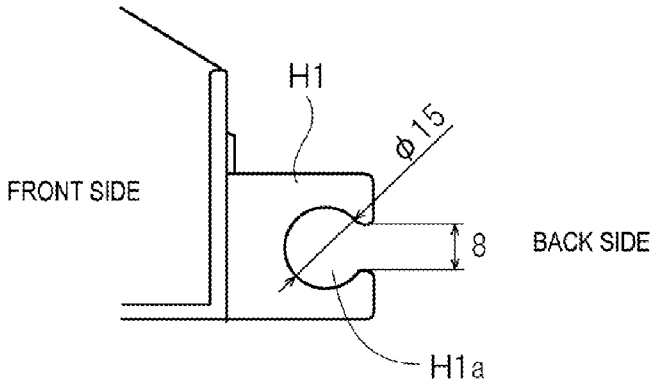

A hook member H1 illustrated in FIG. 6A protrudes from the side surface of the rear surface side (back side of the sheet feeding cassette in the pulling-out direction) of the sheet stacking portion SS1, and the hook member H1 is formed with a circular inserting hole H1*a* in which a part of a rear surface side thereof is opened. In addition, in the present embodiment, the thickness of the hook member H1 in a direction perpendicular to the pulling-out direction of the sheet feeding cassette is 5 mm, and an inner diameter of the inserting hole H1*a* illustrated in FIG. 6B is 15 mm, and a vertical width of the opening portion is 8 mm.

Figure 7A:
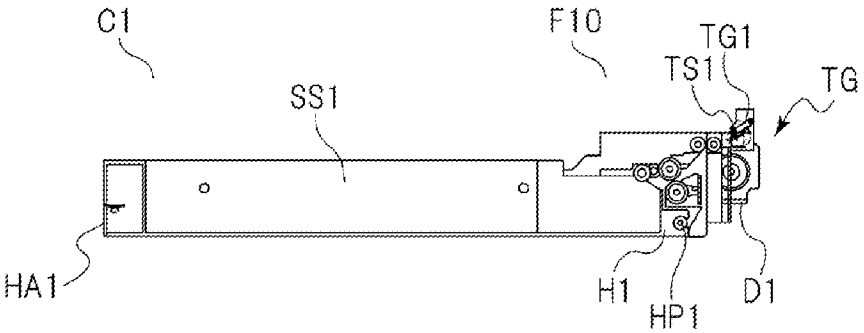
FIGS. 7A and 7B are first diagrams illustrating a configuration of a sheet feeding portion that is provided in the sheet feeding cassette.
Figure 7B:
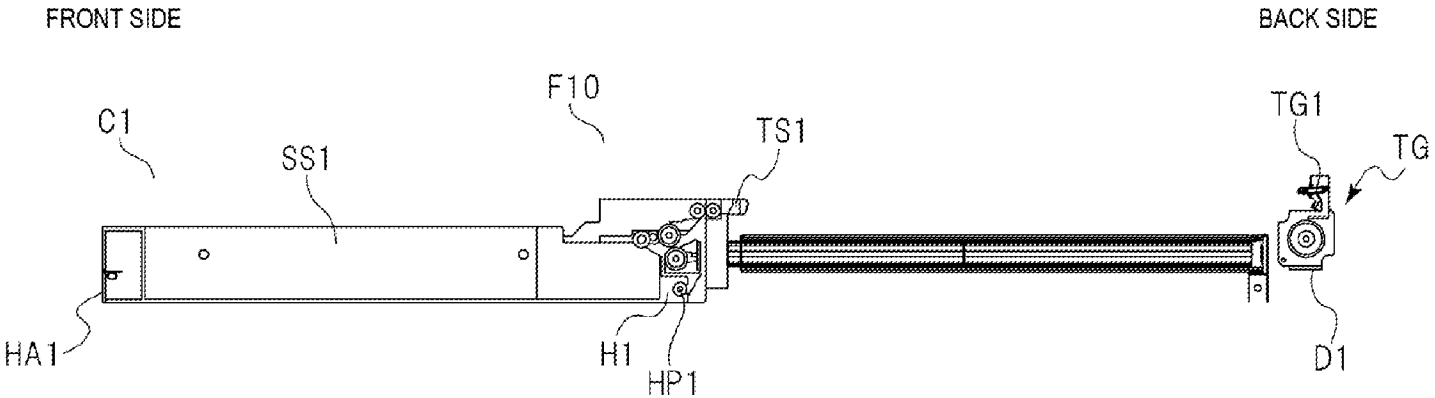

As illustrated in FIG. 7A, the apparatus main body 101 is provided with a toggle mechanism TG that includes an arm TG1 and a toggle spring TS1. In addition, in the insertion direction end portion opposite to the pulling-out direction of the sheet feeding portion F10, a locking portion 50 illustrated in FIGS. 10A to 10E is provided. Moreover, when the upper stage sheet feeding cassette C1 is inserted into the apparatus main body 101, the arm TG1 is locked to the locking portion 50 of the sheet feeding portion F10. Thereafter, the sheet feeding portion F10 is drawn into the back side of the apparatus by the toggles spring TS1 configured to apply force to the arm TG1, and is held in the apparatus main body 101 in the state where the force is applied.

Figure 8A:
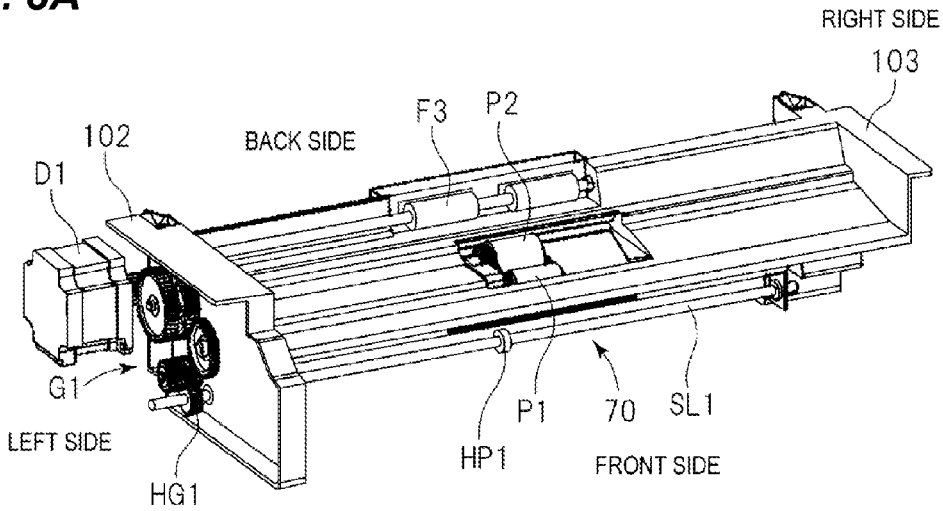
FIGS. 8A to 8C are second diagrams illustrating a configuration of the sheet feeding portion.
Figure 8B:
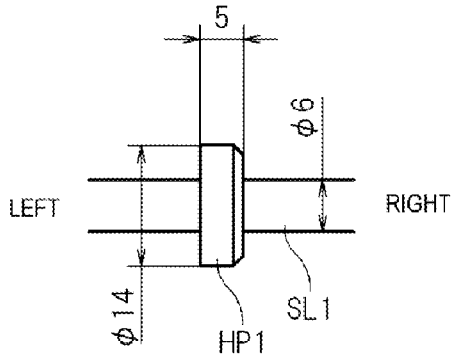
Figure 8C:
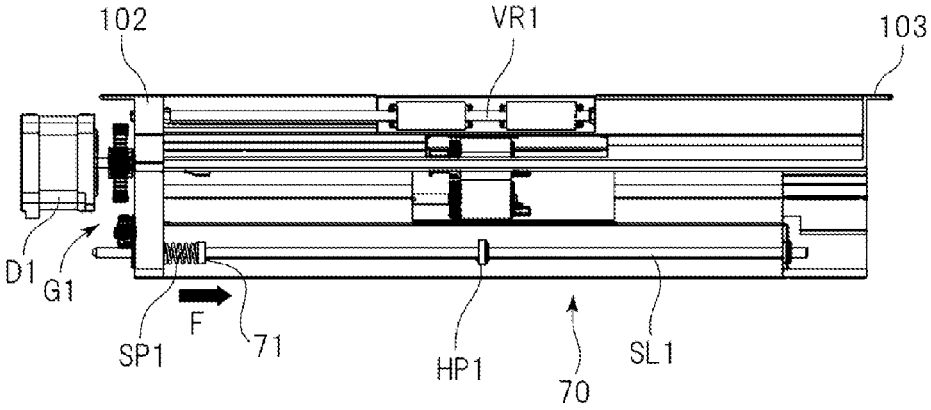

As illustrated in FIG. 8A, the sheet feeding portion F10 is provided with a slide member 70. As illustrated in FIG. 8B, the slide member 70 includes a shaft portion SL1 having a diameter of 6 mm, and a flange portion HP1 provided in the shaft portion SL1 and having an outer diameter of 14 mm and a width of 5 mm. Furthermore, as illustrated in FIG. 8C, the slide member 70 includes a spring bearing portion 71. In FIGS. 8A to 8C, arms 102 and 103 support the pickup roller P1, the feed roller F1, the conveying roller F3, and the slide member 70 in a freely rotatable manner. Moreover, the force is always applied to the slide member 70 in a direction illustrated by an arrow F in FIG. 8C, by a spring SP1 that is provided between the frame 102 and the spring bearing portion 71.

A helical gear HG1 is provided in the end portion of the slide member 70 rotatably supported by the arms 102 and 103. The helical gear HG1 is connected to the sheet feeding driving portion D1 and is driven, when driving is transmitted from the sheet feeding driving portion D1, the helical gear HG1 and the slide member 70 axially slide (move) while rotating.

Driving of the sheet feeding driving portion D1 is transmitted to the pickup roller P1, the slide roller F1, the conveying roller F3, and the helical gear HG1 via a gear portion G1 serving as a transmission portion. In addition, when the sheet is fed from the lower stage sheet feeding cassette C2, when the pickup roller P1 and the slide roller F1 rotate, the sheet is also fed from the sheet feeding cassette C1. Thus, when the sheet is fed from the lower stage sheet feeding cassette C2, the pickup roller P1 and the feed roller F1 are not allowed to rotate by a clutch (not illustrated).

Figure 9A:
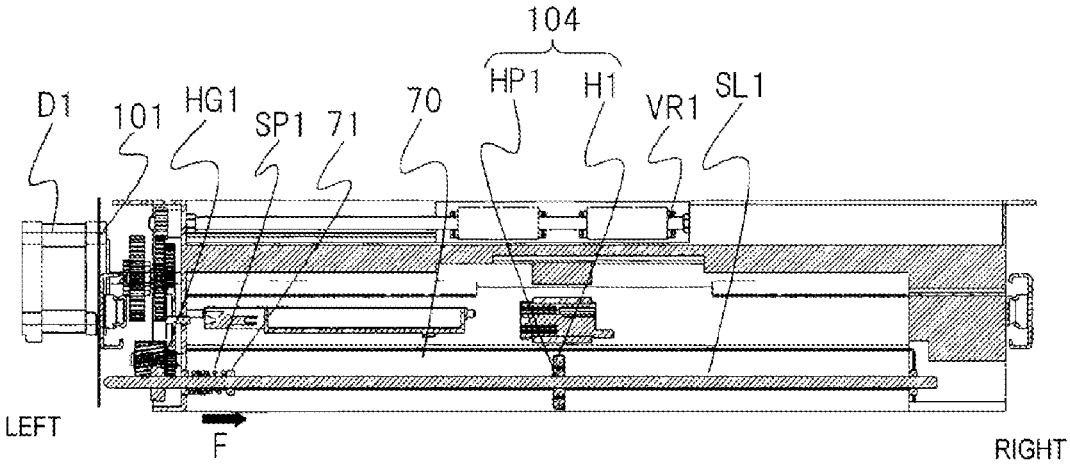
FIGS. 9A and 9B are diagrams illustrating the operation of a slide member that is provided in the sheet feeding portion.

Here, when the sheet feeding driving portion D1 stops in the stop state of the apparatus main body 101, as illustrated in FIG. 9A, force is applied to the slide member 70 by the spring SP1, and the flange portion HP1 moves to a position where the flange portion HP1 enters the inserting hole H1*a* of the hook member H1. When the sheet feeding operation is in the stop state, the flange portion HP1 of the slide member 70 enters the inserting hole H1*a* of the hook member H1 of the sheet stacking portion SS1, and the hook member H1 is engaged with the flange portion HP1.

Thus, when the handle HA1 is operated to release the lock member 52 and to pull out the sheet feeding cassette C1, the flange portion HP1 of the slide member 70 is caught by the hook member H1 of the sheet stacking portion SS1, and the sheet stacking portion SS1 and the sheet feeding portion F10 are integrally pulled out. In the present embodiment, the hook member H1 serving as an engaged member of the sheet stacking portion SS1 and the flange portion HP1 serving as the engaging member of the sheet feeding portion F10 form an engaging portion 104 that engages the sheet stacking portion SS1 with the sheet feeding portion F10 in a freely engaging and disengaging manner.

Figure 10A:
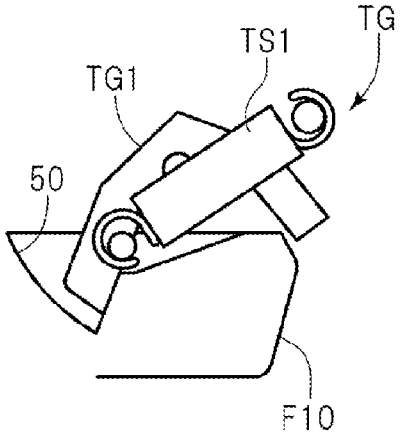
FIGS. 10A to 10E are diagrams illustrating the operation of a toggle mechanism that is provided in the apparatus main body.
Figure 10B:
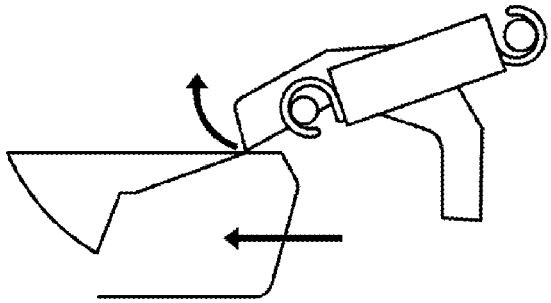
Figure 10C:
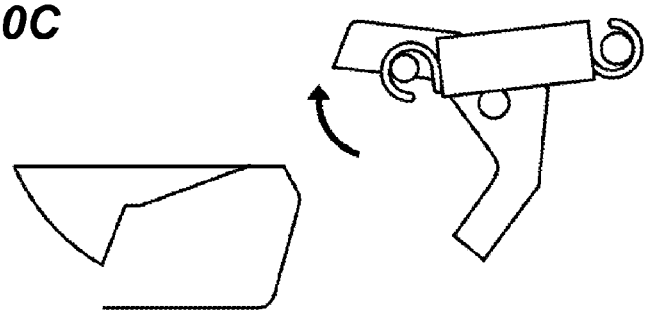

Until the sheet stacking portion SS1 is pulled out, the sheet feeding portion F10 is maintained in the state of being drawn into the back side of the apparatus main body by the toggle mechanism TG serving as a holding portion as illustrated in FIG. 7A. However, in this manner, when the sheet feeding portion F10 is pulled out integrally with the sheet stacking portion SS1, as illustrated in FIG. 10A, the arm TG1 of the toggle mechanism TG moves upward along the locking portion 50 from the position where the arm TG1 is locked to the locking portion 50 of the sheet feeding portion F10. Thus, as illustrated in FIG. 10B, an engaging portion of the arm TG1 moves upward, locking (holding) due to the toggle mechanism TG is released, and the sheet feeding portion F10 is pulled out integrally with the sheet stacking portion SS1. After the sheet feeding portion F10 is pulled out, the arm TG1 is maintained in the raised state by the toggle spring TS1 as illustrated in FIG. 10C.

Figure 10D:
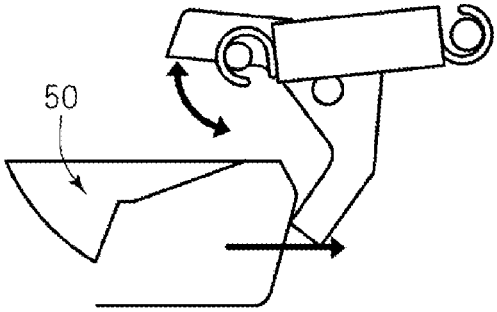
Figure 10E:
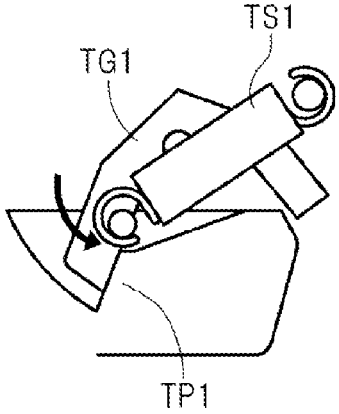

Meanwhile, when the sheet feeding cassette C1 is inserted into the apparatus main body 101, the sheet feeding portion F10 is pushed integrally with the sheet stacking portion SS1. At this time, as illustrated in FIG. 10D, the back side end (back side end in the insertion direction) of the sheet feeding portion F10 comes into contact with the arm TG1 of the toggle mechanism TG stopped in the raised state, and as a result, the engaging portion of the arm TG1 rotates downward. Thereafter, when the sheet stacking portion SS1 is pushed, since the force in the rotation direction applied to the arm TG1 by the toggle spring TS1 changes, as illustrated in FIG. 10E, the arm TG1 is drawn and fixed to the sheet feeding portion F10. Furthermore, when the sheet feeding cassette C1 is inserted into the apparatus main body 101, in the sheet stacking portion SS1, since the lock member 52 is engaged and locked with the engaging pin 53 of the apparatus main body, the sheet feeding cassette C1 is fixed to the apparatus main body 101.

Figure 9B:
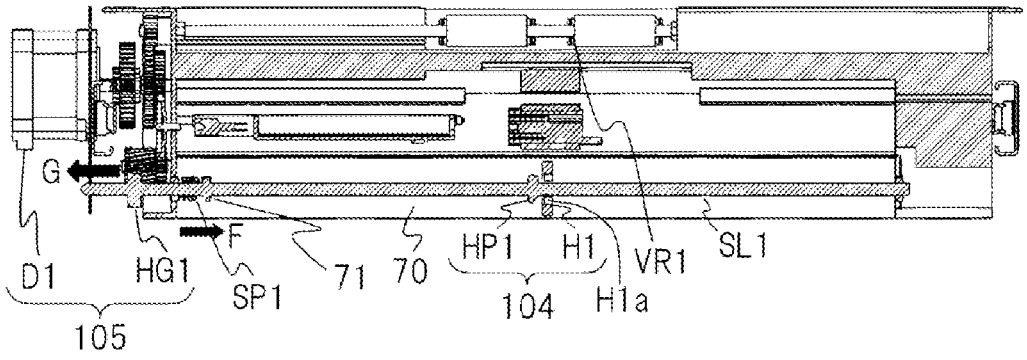

Next, a case where only the sheet stacking portion SS1 is pulled out during operation of the apparatus main body 101 will be described. In this case, as illustrated in FIG. 9B, when the sheet feeding driving portion D1 is driven, driving force is applied to the helical gear HG1, and force in an arrow G direction acts on the helical gear HG1 and the slide member 70 by an helix angle of the helical gear HG1. Thus, the helical gear HG1 and the slide member 70 slide by approximately 8 mm against the spring SP1 while rotating.

Figure 11A:
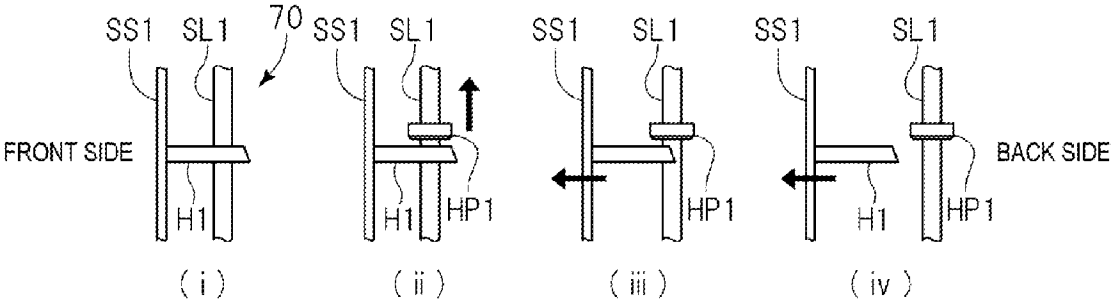
FIGS. 11A to 11C are diagrams illustrating operations of a hook member of the sheet stacking portion and a flange portion of the slide member at the time of attachment and detachment of the sheet feeding cassette.

As illustrated in (i) of FIG. 11A, an amount of overlap when the flange portion HP1 of the slide member 70 is engaged with the hook member H1 of the sheet stacking portion SS1 is 5 mm. Thus, when the slide member 70 slides by 8 mm, as illustrated in (ii) of FIG. 11A, the positions of the flange portion HP1 and the hook member H1 are completely shifted, and the engagement between the flange portion HP1 and the hook member H1 is released. As illustrated in FIGS. 9A and 9B, an engaging and disengaging portion 105, which releases the engagement between the hook member H1 and the flange portion HP1 so that only the sheet stacking portion SS1 can be pulled out when the apparatus main body 101 is operated, is formed by the sheet feeding driving portion D1 and the helical gear HG1.

The opening width of the hook member H1 is 8 mm, and an outer diameter of the shaft portion SL1 of the slide member 70 is 6 mm. Thus, when the sheet stacking portion SS1 is pulled out, as illustrated in (iii) of FIG. 11A, the hook member H1 is caught by neither the shaft portion SL1 of the slide member 70 nor the flange portion HP1. At this time, since the sheet feeding portion F10 is drawn into the rear surface side by the toggle mechanism TG, when the handle HA1 is operated, as illustrated in (iv) of FIG. 11A, only the sheet stacking portion SS1 is pulled out. With such a configuration, even during operation of the apparatus main body 101, only the sheet stacking portion SS1 can be pulled out.

Figure 11B:
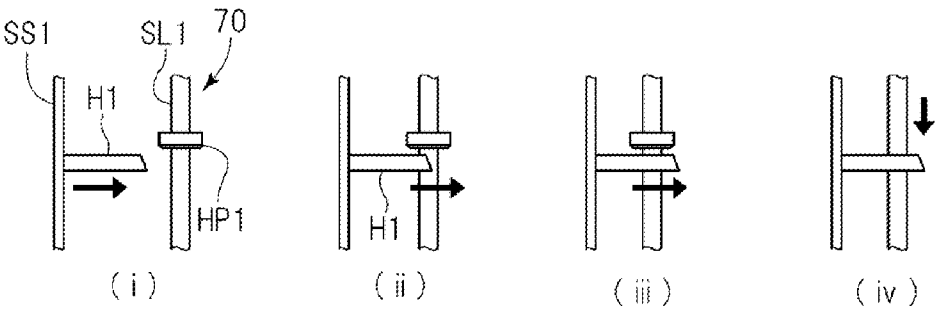

Meanwhile, as illustrated in (i) of FIG. 11B, when the pulled sheet stacking portion SS1 is inserted, as illustrated in (ii) and (iii) of FIG. 11B, the shaft portion SL1 of the slide member 70 enters the hook member H1. Thereafter, when the sheet feeding driving portion D1 stops, the slide member 70 which has slid against the spring SP1 slides in an arrow direction illustrated in (iv) of FIG. 11B, and the flange portion HP1 enters the inserting hole H1*a* of the hook member H1. Thus, the sheet stacking portion SS1 is engaged with the sheet feeding portion F10.

In addition, when the sheet stacking portion SS1 is pulled out, there are cases where the sheet feeding driving portion D1 may stop. In this case, as illustrated in (i) of FIG. 11C, the slide member 70 is pushed back by the spring SP1. Moreover, when the sheet stacking portion SS1 is pushed in this state, as illustrated in (ii) of FIG. 11C, the hook member H1 comes into contact with the flange portion HP1 of the slide member 70. However, since an inclined surface is formed on a leading end of the hook member H1, when the sheet stacking portion SS1 is pushed, as illustrated in (iii) of FIG. 11C, the slide member 70 slides in an arrow G direction against the spring SP1.

Figure 11C:
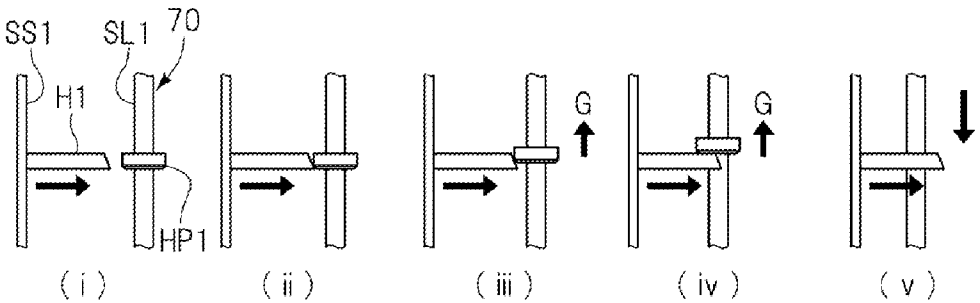

Moreover, when the sheet stacking portion SS1 is further pushed, as illustrated in (iv) of FIG. 11C, the hook member H1 enters the shaft portion SL1 of the slide member 70. After the hook member H1 enters the shaft portion SL1 of the slide member 70, the slide member 70 which has slid against the spring SP1 slides in an arrow direction illustrated in (v) of FIG. 11C, and the flange portion HP1 enters the inserting hole H1*a* of the hook member H1. Thus, the flange portion HP1 is engaged with the hook member H1, and the sheet stacking portion SS1 is engaged with the sheet feeding portion F10. Although the configuration of the upper stage sheet feeding cassette C1 has been described above, the lower stage sheet feeding cassette C2 also has the same configuration.

Figure 12:
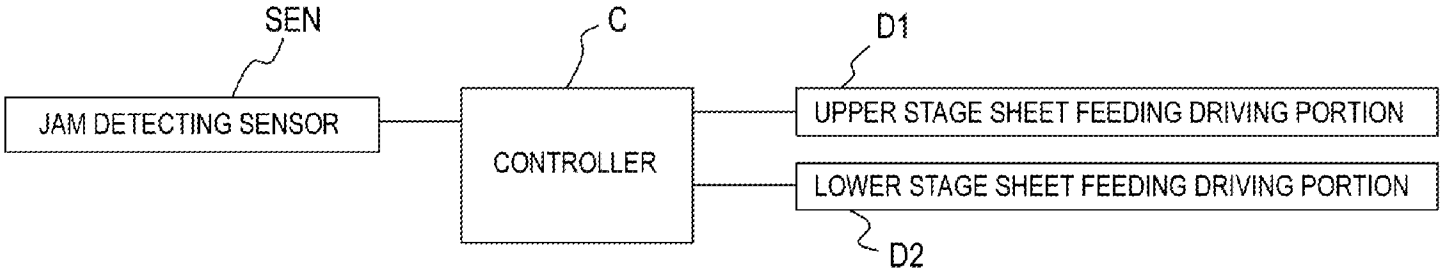
FIG. 12 is a control block diagram illustrating engaging and disengaging control to be performed on the sheet stacking portion of the sheet feeding portion.

In addition, FIG. 12 is a control block diagram illustrating engaging and disengaging control to be performed on the sheet stacking portion of the sheet feeding portion. As illustrated in FIG. 12, a jam detecting sensor SEN is connected to the controller C, and the detection signal from the jam detecting sensor SEN is input to the controller C. Furthermore, the controller C is connected to the upper stage sheet feeding driving portion D1 and the lower stage sheet feeding driving portion D2, and the respective sheet feeding portions D1 and D2 are driven by the instruction from the controller C.

Figure 13:
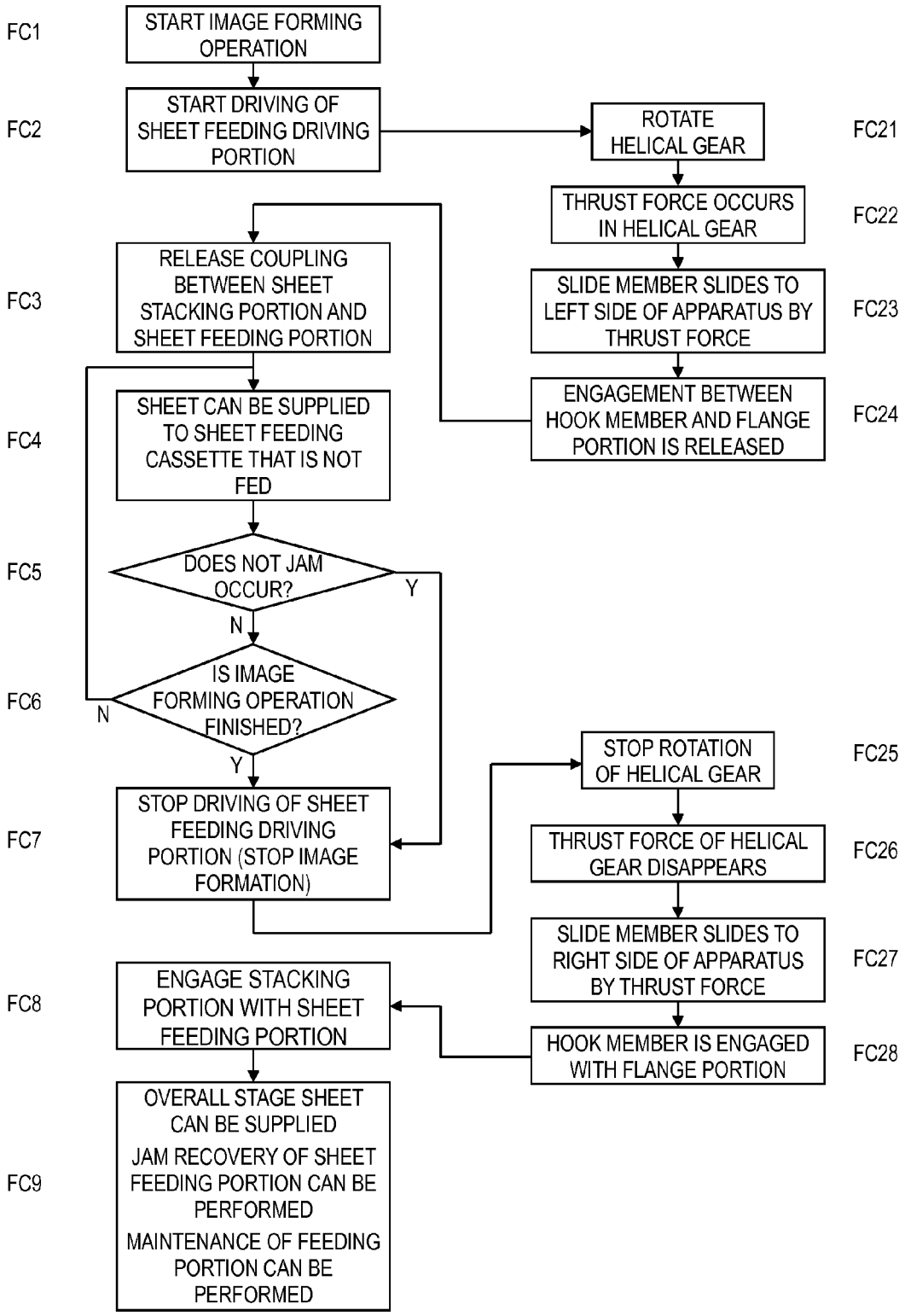
FIG. 13 is a flowchart of the engaging and disengaging control of the block diagram.

Next, the engaging and disengaging control of the sheet feeding portion with respect to the sheet stacking portion using the controller will be described using a flowchart illustrated in FIG. 13. When the image forming operation starts (FC1), first, the controller C starts to drive the sheet feeding driving portion D1 (FC2). Thus, the helical gear rotates (FC21), when the helical gear rotates, thrust force occurs (FC22), and the slide member slides to the left side of the apparatus (see FIGS. 8A to 8C) (FC23).

Moreover, when the slide member slides, the engagement between the hook member and the flange portion is released (FC24), and coupling between the sheet stacking portion and the sheet feeding portion is released (FC3). Herein, when coupling between the sheet stacking portion and the sheet feeding portion is released, only the sheet stacking portion can be pulled out, accordingly, the sheet can be supplied to the sheet stacking portion of the sheet feeding cassette, which does not feed (FC4).

Next, the controller C determines whether a jam does not occur based on the detection signal from the jam detecting sensor SEN (FC5), when a jam does not occur (N in FC5), next, the controller C determines whether the image forming operation is finished (FC6). Moreover, when the image forming operation is finished without an occurrence of jam (Y in FC6), driving of the sheet feeding driving portion D1 is stopped (FC7), and the rotation of the helical gear is stopped (FC25). Thus, thrust force of the helical gear disappears (FC26), as a result, slide member slides to the right side of the apparatus by spring force (see FIGS. 8A to 8C) (FC27), and the hook member is engaged with the flange portion (FC28). As a result, the sheet stacking portion is engaged with the sheet feeding portion (FC8), and the sheet supply to the sheet feeding cassettes of the entire stage and the maintenance of the sheet feeding portion can be performed. Furthermore, even when a jam does not occur in the sheet feeding portion, the jam recovery can be performed (FC9).

Furthermore, when the controller C determines that a jam occurs based on the detection signal from the jam detecting sensor SEN (Y in FC5), the controller C stops driving of the sheet feeding driving portion (FC7) and stops the rotation of the helical gear (FC25). Thus, thrust force of the helical gear disappears (FC26), as a result, the slide member slides to the right side of the apparatus by spring force (FC27), and the hook member is engaged with the flange portion (FC28). As a result, the sheet stacking portion is engaged with the sheet feeding portion (FC8), and the sheet supply to the sheet feeding cassettes of the entire stage and the maintenance of the sheet feeding portion can be performed. Furthermore, even when a jam occurs in the sheet feeding portion, the jam recovery can be performed (FC9).

Figure 14A:
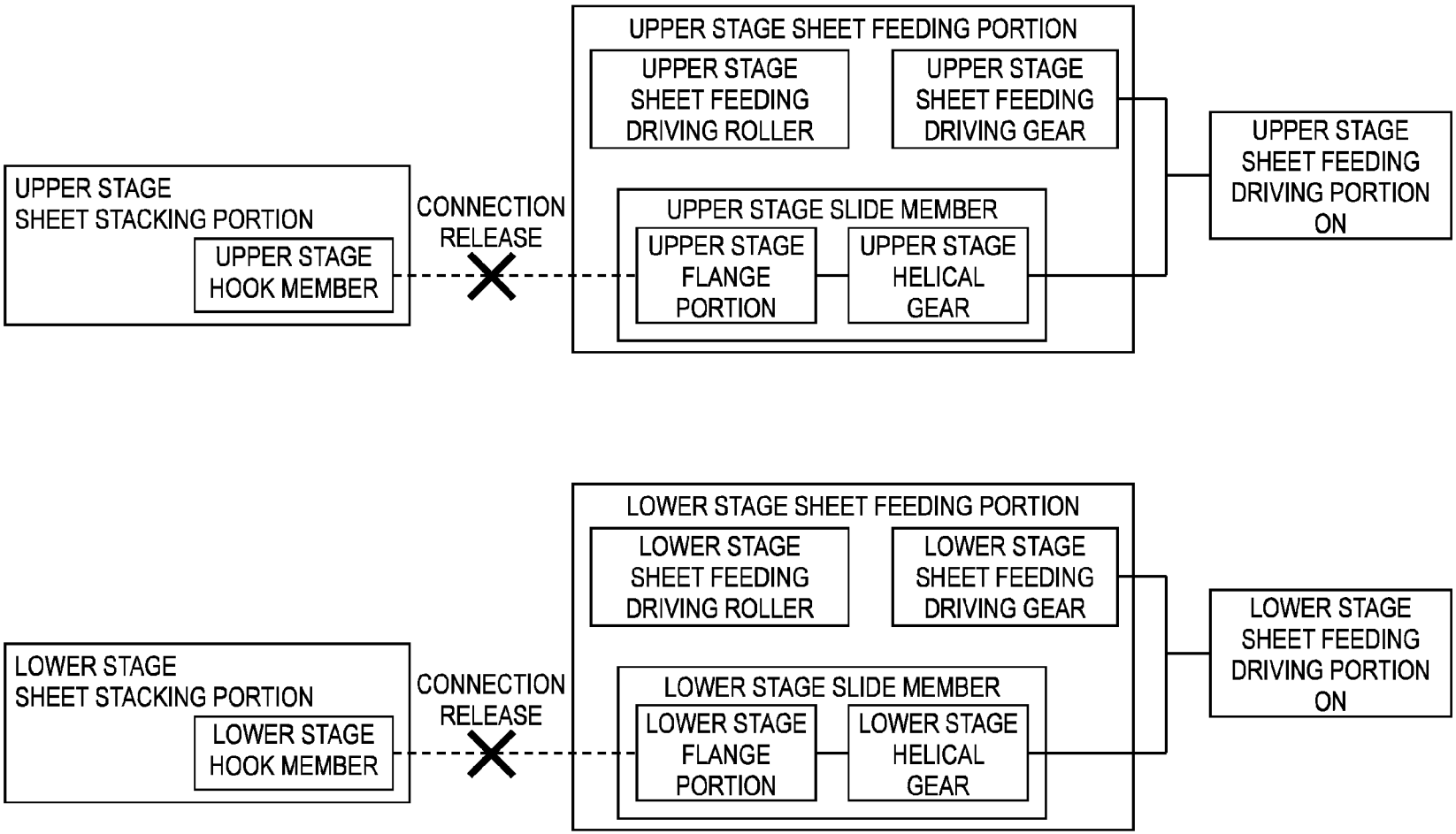
FIGS. 14A and 14B are first diagrams illustrating a relation between ON and OFF of a sheet feeding driving portion configured to drive the sheet feeding portion and the engagement and disengagement of the sheet feeding portion and the sheet stacking portion.
Figure 14B:
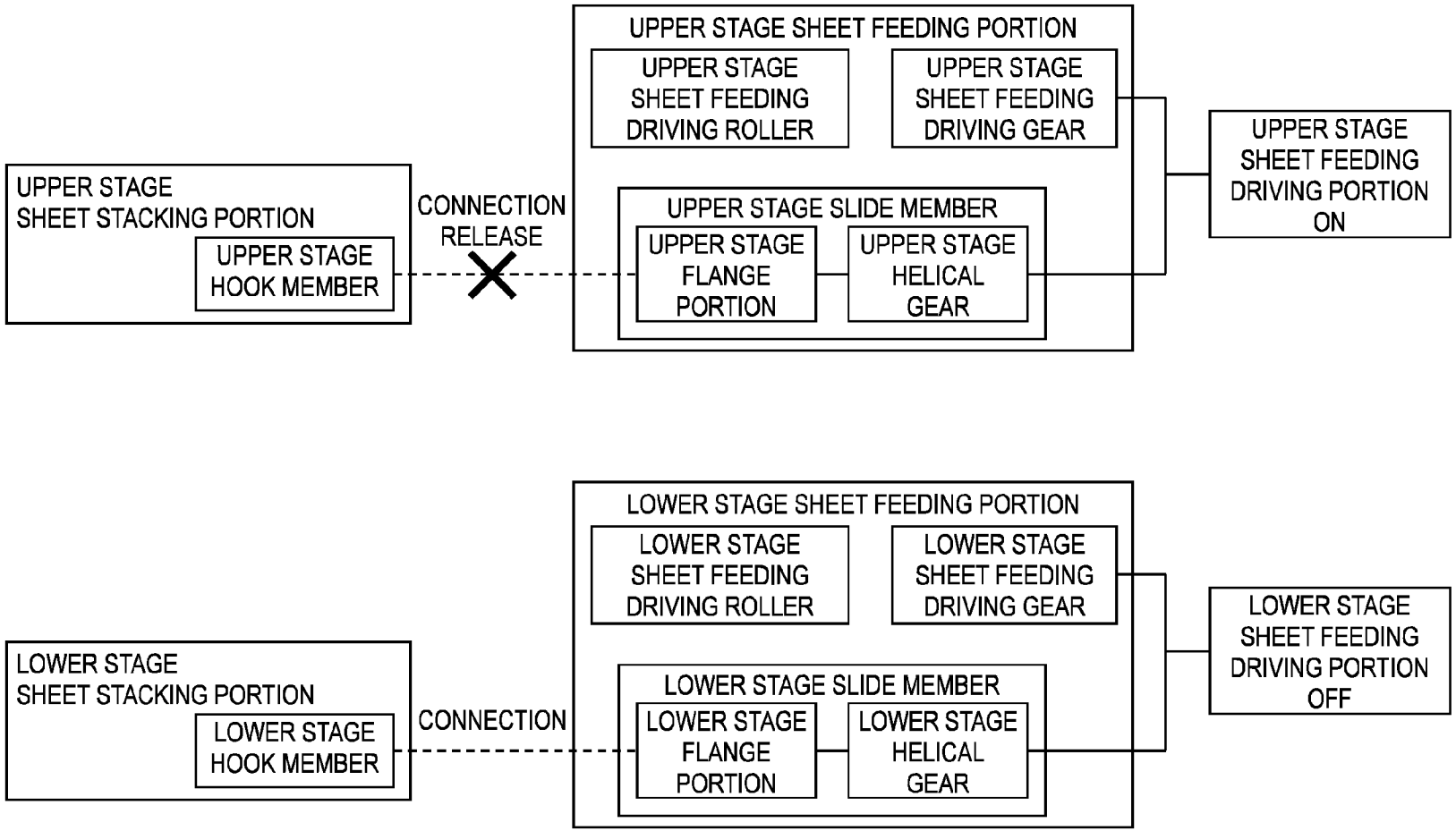
Figure 15:
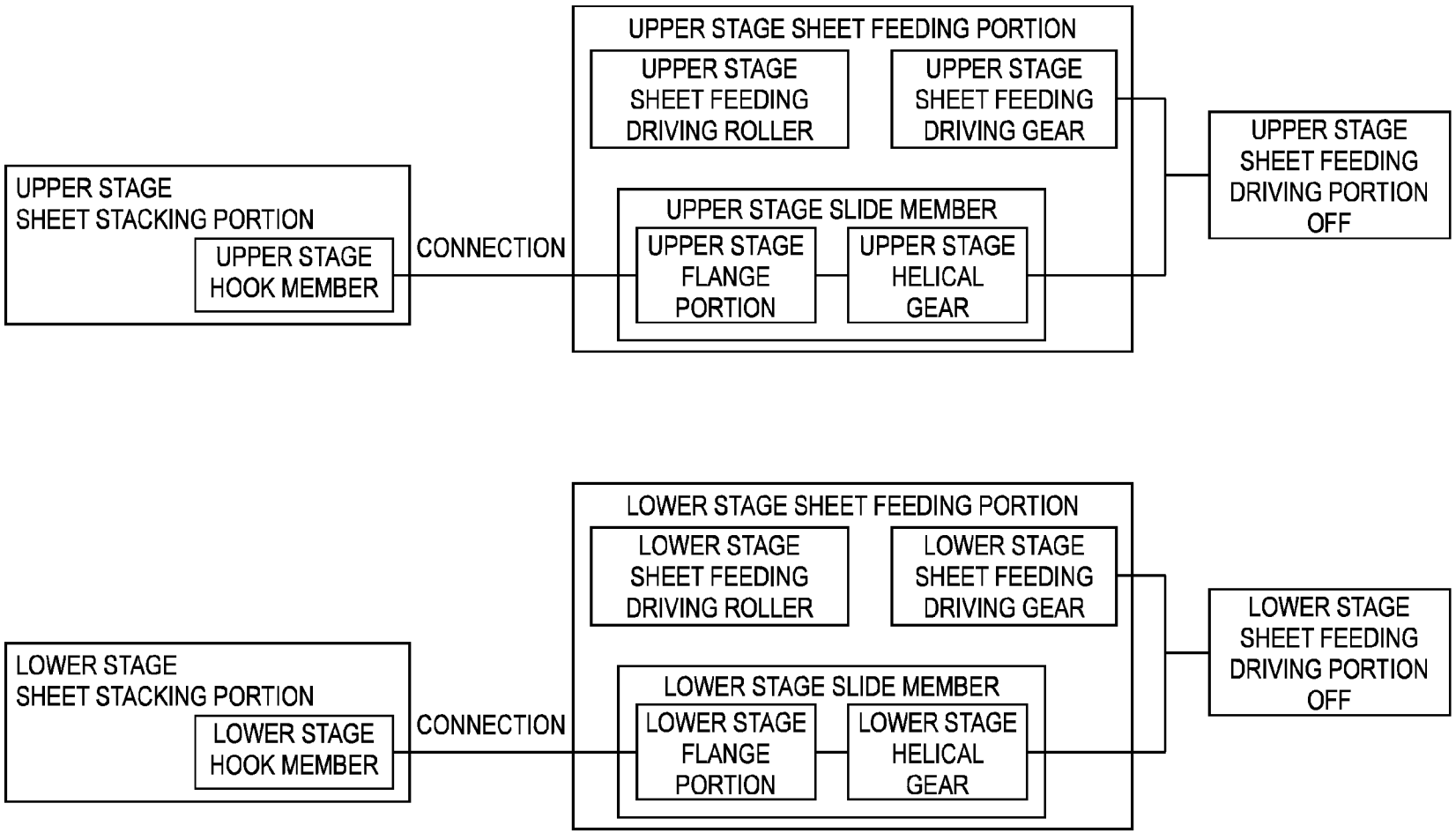
FIG. 15 is a second diagram illustrating a relation between ON and OFF of the sheet feeding driving portion and the engagement and disengagement of the sheet feeding portion and the sheet stacking portion.

FIGS. 14 and 15 are diagrams illustrating a relation between ON and OFF of the sheet feeding driving portion and engagement and disengagement between the sheet feeding portion and the sheet stacking portion. In addition, ON and OFF of the sheet feeding driving portion illustrated in FIG. 5 also represent the same relation. FIG. 14A is a diagram illustrating a state when the sheet feeding driving portions of the upper stage and the lower stage are turned ON, and at the time of this state, the connection (engagement) between the sheet stacking portion and the sheet feeding portion is released in both upper stage and lower stage. FIG. 14B is a diagram illustrating a state when the sheet feeding driving portion of the upper stage is turned ON, at the time of this state, the connection between the sheet stacking portion of and the sheet feeding portion in the upper stage is released, and the sheet stacking portion and the sheet feeding portion of the lower stage are connected to each other. FIG. 15 is a diagram illustrating a state when the feeding and driving portions of the upper stage and the lower stage are turned OFF, at the time of this state, the sheet stacking portion is connected to the sheet feeding portion in both upper stage and lower stage.

As described above, in the present embodiment, when the sheet feeding operation using the lower sheet feeding cassette is performed only in the sheet stacking portion is pulled out, and when the sheet feeding operation is stopped, the sheet stacking portion and the sheet feeding portion are integrally pulled out. Thus, in the image forming apparatus provided with the sheet feeding cassettes of a plurality of stages, even while any one sheet feeding cassette feeds and conveys the sheet in the sheet feeding cassette, the sheet can be supplied to the sheet feeding cassette that does not fed the sheet. Furthermore, at the time of removal of a jammed sheet and at the time of maintenance of the sheet feeding portion, the work can also be performed from the front of the image forming apparatus main body, and operation performances and access characteristics of the image forming apparatus can be satisfactory.

Figure 16A:
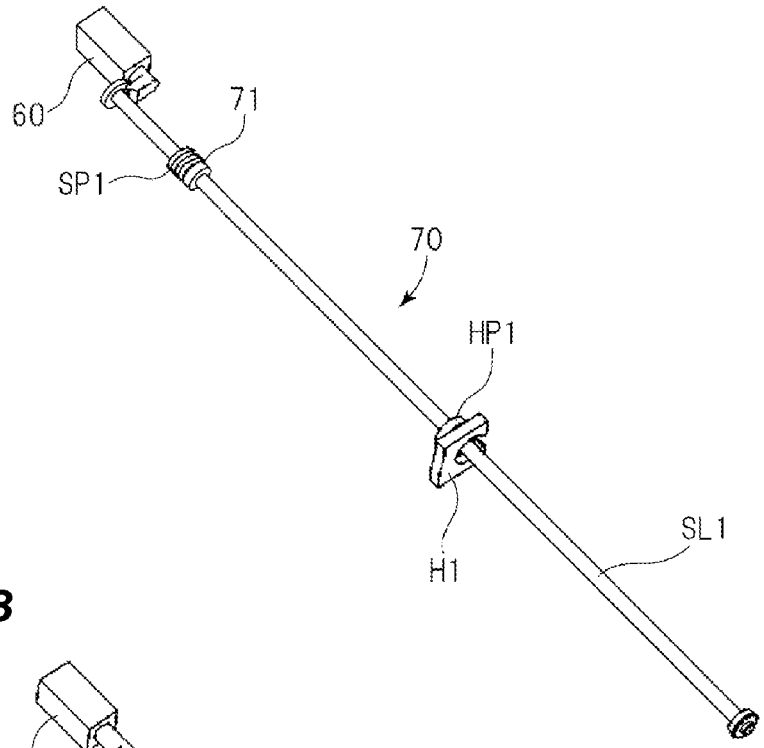
FIGS. 16A and 16B are diagrams illustrating another configuration that allows the slide member to slide.
Figure 16B:
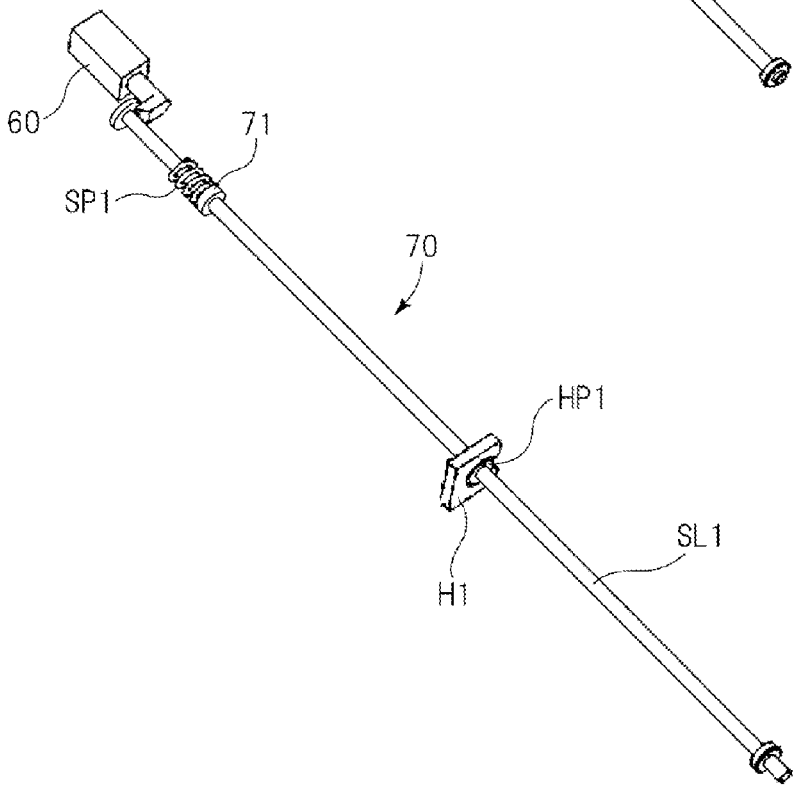

Furthermore, in the above-mentioned description, for example, as illustrated in FIGS. 16A *and* 16B, a solenoid 60 may be provided in the apparatus main body to allow the slide member 70 to slide. Moreover, as illustrated in FIG. 16A, when the sheet feeding driving portion is driven, the solenoid 60 is operated to allow the slide member 70 to slide, and the engagement between the sheet stacking portion and the sheet feeding portion F10 is released.

Furthermore, in the above-mentioned description, although an example has been described in which the engaging portion 104 is formed by the flange portion HP1 of the slide member 70 and the hook member H1 of the sheet stacking portion SS1, the invention is not limited thereto. For example, the engaging portion 104 may be formed by an oscillating hook and a pin.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-179525, filed Aug. 13, 2012, which is hereby incorporated by reference herein in its entirety.

What is claimed is:

1. An image forming apparatus comprising:

an image forming apparatus main body;

a first sheet feeding cassette which is vertically disposed on the lower side of the image forming apparatus main body and is capable of being pulled out from the apparatus main body, and which has a first sheet storing portion to store a sheet and a first sheet feeding portion provided on the back side of the first sheet storing portion in a pulling-out direction to feed the sheet stored in the first sheet storing portion;

a second sheet feeding cassette which is vertically disposed on the lower side of the first sheet feeding cassette and is capable of being pulled out from the apparatus main body, and which has a second sheet storing portion to store a sheet and a second sheet feeding portion provided on the back side of the second sheet storing portion in a pulling-out direction to feed the sheet stored in the second sheet storing portion;

an engaging portion which engages the first sheet storing portion and the first sheet feeding portion in an engaging and disengaging manner; and an engaging and disengaging portion which releases and maintains an engagement of the engaging portion, wherein in a case where a sheet feeding operation by the second sheet feeding portion is performed, the engaging and disengaging portion releases the engagement of the engaging portion so that only the first sheet storing portion of the first sheet feeding cassette is pulled out, and in a case where the sheet feeding operation of the second sheet feeding portion stops, the engaging and disengaging portion maintains the engagement of the engaging portion so that the first sheet storing portion and the first sheet feeding portion are integrally pulled out.

2. The image forming apparatus according to claim 1, wherein the first sheet feeding portion of the first sheet feeding cassette is provided with a sheet conveying route extended vertically, through which the sheet fed from the second sheet feeding cassette passes.

3. The image forming apparatus according to claim 1, further comprising:

a holding portion that is provided in the image forming apparatus main body, and holds the first sheet feeding portion so that only the first sheet storing portion is pulled out when the first sheet feeding cassette is pulled out in a state where the engagement of the engaging portion between the first sheet storing portion and the first sheet feeding portion is released.

4. The image forming apparatus according to claim 1, wherein the engaging portion includes an engaging member provided in the first sheet feeding portion, and an engaged member provided in the first sheet storing portion, when a sheet feeding operation is performed by the second sheet feeding portion, the engaging and disengaging portion moves the engaging portion to a position where the engagement between the engaging member and the engaged member is released, and when the sheet feeding operation of the second sheet feeding portion stops, the engaging and disengaging portion moves the engaging portion to a position where the engaging portion is engaged with the engaged member.

5. The image forming apparatus according to claim 4, wherein the engaging and disengaging portion is provided in the image forming apparatus main body, and the engaging and disengaging portion includes a driving portion that drives the first sheet feeding portion of the first sheet feeding cassette, and a transmission portion that transmits driving of the driving portion to the engaging member.

6. The image forming apparatus according to claim 4, wherein the engaging and disengaging portion is a solenoid that is provided in the image forming apparatus main body.

7. The image forming apparatus according to claim 1, wherein the first sheet feeding portion has a pickup roller, a separating portion to separate the sheet fed by the pickup roller and a conveying portion to convey the sheet separated by the separating portion toward the image forming portion, and the conveying portion conveys the sheet fed from the second sheet feeding portion.

* * * * *